US005542838A

United States Patent [19]

Wilhelm et al.

[11] Patent Number: 5,542,838

[45] Date of Patent: Aug. 6, 1996

[54] SYSTEM PROVIDING RAPID DIE CHANGE CAPABILITY TO A PELLET MILL

[75] Inventors: Donald M. Wilhelm, Novato; Verne A. Hubalek, San Rafael; S. Andrew Smith, San Francisco; Robert Immergluck, Fairfield, all of Calif.

[73] Assignee: California Pellet Mill Company, San Francisco, Calif.

[21] Appl. No.: 326,150

[22] Filed: Oct. 19, 1994

Related U.S. Application Data

[63] Continuation of Ser. No. 884,686, May 18, 1992, abandoned.

[51] Int. Cl.[6] ..... B30B 11/20; B30B 15/02; B66F 9/18

[52] U.S. Cl. ..... 425/186; 411/352; 411/353; 411/397; 411/999; 425/194; 425/331; 425/365; 425/374; 425/DIG. 230

[58] Field of Search ..... 425/331, 365, 425/374, 186, 189, 194, DIG. 230; 411/352, 353, 999, 397

[56] References Cited

U.S. PATENT DOCUMENTS

| | | | |
|---|---|---|---|
| 1,026,035 | 5/1912 | Hedder | 411/999 |
| 2,908,038 | 10/1959 | Meakin | 425/331 |
| 2,981,212 | 4/1961 | Landers | 425/154 |
| 2,994,918 | 8/1961 | Landers | 425/DIG. 230 |
| 3,010,150 | 11/1961 | Meakin . | |
| 3,139,844 | 7/1964 | Landers | 425/162 |
| 3,191,227 | 6/1965 | Keefe | 425/331 |
| 3,354,845 | 11/1967 | Schultz | 425/331 |
| 3,358,328 | 12/1967 | Kuhn et al. | 425/DIG. 230 |
| 3,511,190 | 5/1970 | Kunz | 425/331 |
| 3,825,387 | 7/1974 | Gilman | 425/182 |
| 3,911,550 | 10/1975 | Gilman . | |
| 3,981,664 | 9/1976 | Bittner et al. | 425/331 |
| 4,056,207 | 11/1977 | Spilker . | |
| 4,179,257 | 12/1979 | Heesen | 425/331 |
| 4,234,298 | 11/1980 | Spielhoff | 425/186 |
| 4,403,936 | 9/1983 | Heesen | 425/331 |
| 4,710,120 | 12/1987 | Chapman | 425/185 |
| 5,006,056 | 4/1991 | Mainstone et al. | 425/186 |

FOREIGN PATENT DOCUMENTS 2533482 3/1984 France .

*Primary Examiner*—Jay H. Woo
*Assistant Examiner*—Joseph Leyson
*Attorney, Agent, or Firm*—Robert F. Palermo; Michael H. Minns

[57] ABSTRACT

A quick die change capability is provided to a pellet mill by means of a fixture spider which can be attached to the pelleting die and to the rollers for a unitized roller/die cartridge. By employment of quick acting captive die clamps, as well as push-pull jacks, assembly and dismantling of the die/roller cartridge in the mill is simplified. Three axis adjustability of the fixture spider enhances ease of alignment.

11 Claims, 6 Drawing Sheets

SYSTEM PROVIDING RAPID DIE CHANGE CAPABILITY TO A PELLET MILL

This application is a continuation of application Ser. No. 07/884,686, filed May 18, 1992, now abandoned.

BACKGROUND OF THE INVENTION

This invention relates generally to pelleting mills for pelletizing particulate materials and more particularly to an apparatus which permits rapid die changes whenever such changes are required due to changes in feed materials or in pellet size requirements.

The performance of a pellet mill is dictated to a great extent by the geometric configuration of the holes in the die in which the pellets are formed. The number, diameter, and length of the holes are important factors in die performance, for a given type of feed material. Many mills use a single die regardless of the material being pelletized; because by so doing they avoid the costs of a large inventory of dies as well as the time required for die changes.

This, however, results in compromising the quality and quantity of pellets produced in the mill, e.g., for animal feeds, if the die holes are too long for a given feed, the capacity of the pellet mill can be significantly reduced. Moreover, the excess hole length may require that feed conditioning temperatures be reduced which, in turn, reduces the sterilization and gelatinization actions which should take place during the conditioning and pelletizing processes. If the hole is too short, the pellets may have low durability due to inadequate compression and gelatinization. Neither situation is acceptable in production of high quality feed pellets, and the result is downgrading of the pellets so produced.

To avoid such compromises of quality, pellet mill operators have resorted to quick die change pellet mills. One such mill, referred to as a rapid die clamping mill, reduces the time required for releasing and reclamping the dies during replacement. Conventional material handling equipment such as overhead hoists, hydraulic jacks, and wheeled carts are used in this type of system. Although these aids reduce operator physical effort requirements, they provide no assistance in alignment of the dies, and they do not prevent cocking and wedging of the die on the precision fitted mating surfaces. Such systems also incorporate a multiplicity of precision parts which, being permanently attached to the pellet mill, are subject to excessive wear and corrosion damage. Finally, these systems do not improve roller changing ease or time. This is a drawback because it is often required to change rollers with the dies due to matching wear patterns developed between the dies and rollers during operation. Operation of mixed roller/die sets results in premature roller/die wear and failure. As a result, the rapid die clamping mill often does not provide adequate savings of time and improvement of performance to justify the additional cost entailed.

Another system provides a main shaft/quill shaft roller/die cartridge which can be removed and replaced as a unit. This has the advantage of rapid changeover together with retention of the dies and rollers as matched sets. Despite these valuable advantages, there are several real drawbacks to the main shaft/quill shaft cartridge system including cost, mass, size, risk of accidents, and alignment of the cartridge with the mill housing and drive unit.

Each die in this system requires a cartridge including a die, rollers, die clamps, main shaft, quill shaft, front roller support, cone, and deflectors. For mills requiring several die specifications, the cost of the several cartridges becomes a major drawback of this system. The mass of a complete cartridge, especially with the large dies now in use, becomes very large. This large mass requires heavy duty materials handling equipment for transporting, installing, and removing cartridges during die changes. The limited work space around the pelletizing mills found in most feed mills cannot accommodate this heavy duty equipment and leads to employment of combinations of smaller handling equipment which may contribute to accidental damage to the mill and injury to operating personnel. Carts, which would normally be preferred for moving dies about in the feed mill, may become unstable when loaded with a main shaft/quill shaft roller/die cartridge. This is attributable to the overhang of the extended main shaft and the consequent displacement of the center of gravity of the cart/cartridge couple to a point of marginal stability, the risks of which are readily appreciated.

In addition to the drawbacks already discussed, the main shaft/quill shaft cartridge does not satisfactorily provide for ease of alignment of the precision fitted surfaces of the cartridge with the mating surfaces of the pellet mill housing and drive unit. These mating surfaces are within the mill, so that they are not visible once the cartridge is positioned in front of the mill during installation. This leads to a "push and hope" approach to cartridge insertion which may result in damage to precision fitted surfaces and to jamming of mating parts in a misaligned orientation. The alignment criticality requires precision multi-axis adjustment as well as elevation and traverse capability for the cart. All alignment parameters for current die change systems are referenced from the floor in front of the pellet mill which, due to wear and other damage, may be unreliable.

The operator must also be skilled in alignment techniques for cartridge installation in order to avoid damage and downtime caused by misalignment and jamming. This introduces an additional element of operator sensitivity to the performance of the system and results in unacceptable variability.

Finally, long running times without die changes sometimes cause exhaustion of the lubricant between the mating surfaces of the cartridge and pellet mill. This can result in running dry and in bonding of the mating surfaces together under vibratory loading conditions. The result is extreme difficulty in separating the cartridge from the pellet mill. Design of mating surfaces with tapers to prevent sticking requires high axial clamping forces in order to maintain secure contact between the surfaces. Any loosening of the clamping force during operation causes rapid wear of the tapered surfaces and of the keys and keyways.

Thus, although it is desirable to employ a die which is precisely suited to the feed material being pelletized, the costs, risks, and difficulties attendant upon such a practice make it less attractive. As a result, some mills are forced to operate at a less than optimum efficiency and to produce pellets of inferior quality.

The foregoing illustrates limitations known to exist in present die changing systems for pellet mills. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by a fixture for positively gripping a pellet mill die for removing said die from and for installing said die in a pellet mill comprising a fixture spider having a plurality of rigidly mounted arms projecting outwardly a sufficient distance to provide registration with a plurality of attachment sites on an annular axial circular face of said die; means, distally disposed on said arms, for positively attaching said fixture spider to said attachment sites on said axial circular face of said die; and means for moving said fixture spider along three orthogonal axes to align said means for positively attaching with said attachment sites on said axial circular face of the die.

The foregoing and other aspects will become apparent from the following detailed description of the invention when considered in conjunction with the accompanying drawing figures.

BRIEF DESCRIPTION OF THE DRAWING FIGURES

Figure 5:
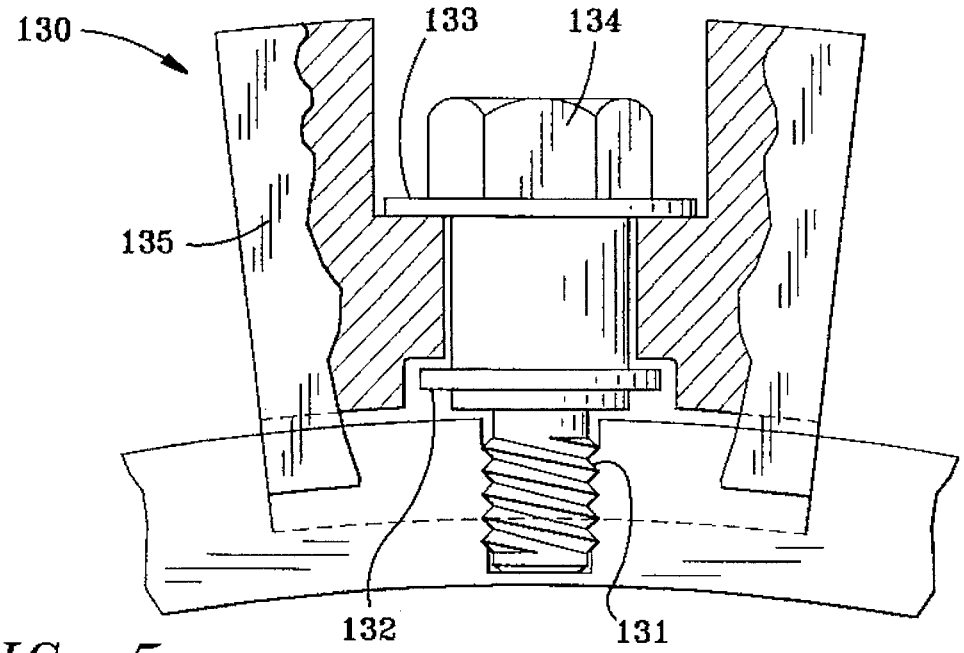
Figure 5A:
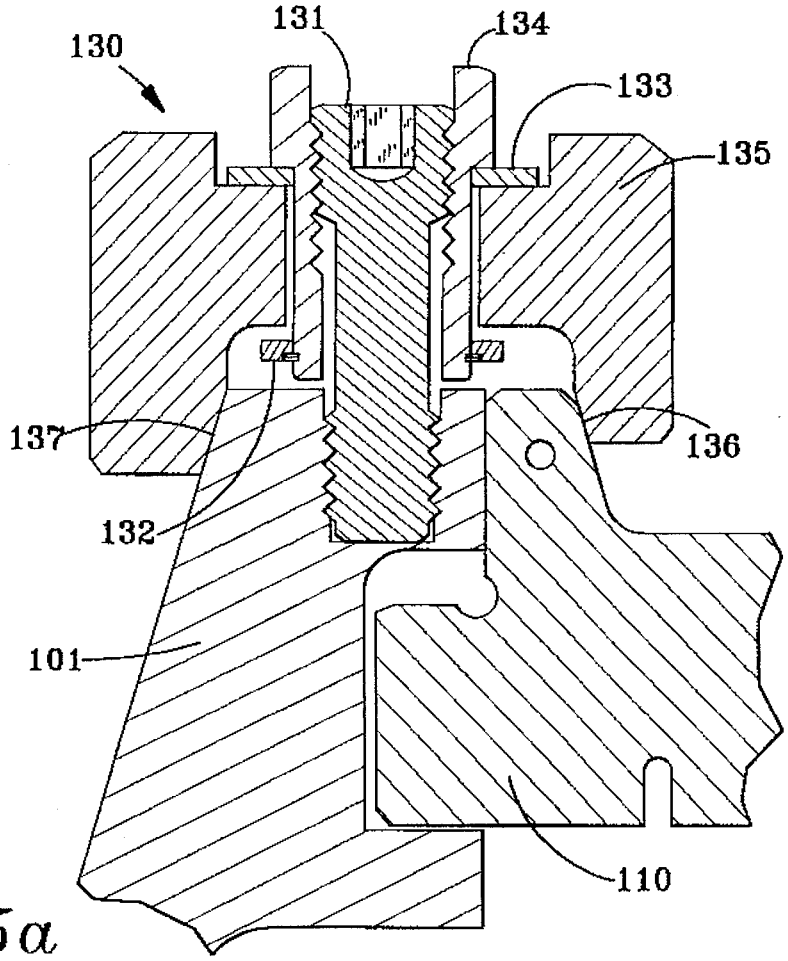
Figure 6:
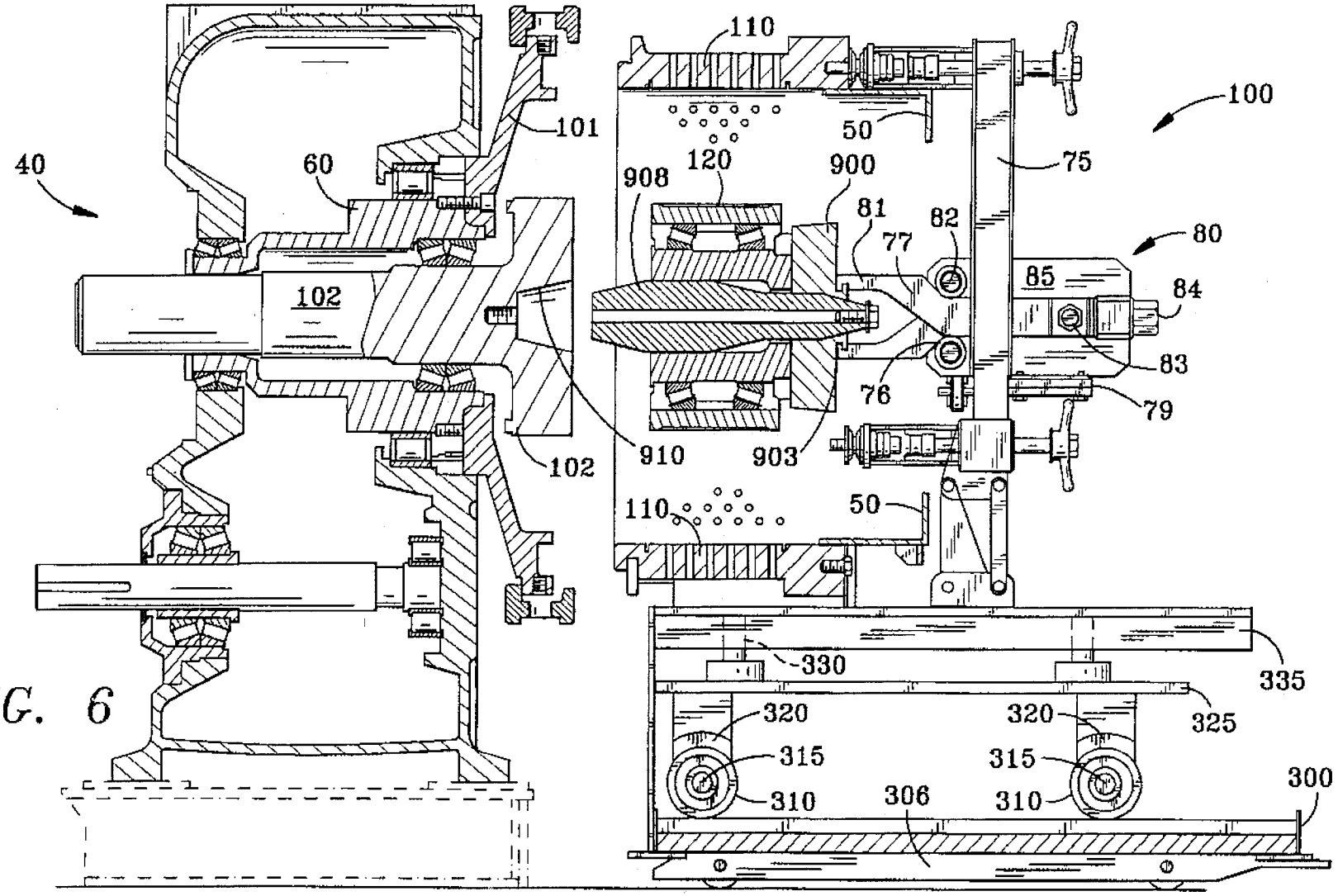

FIGS. 5 and 5*a* show a die clamp used with the system of the invention for securing the die to the quill shaft of the pellet mill; and FIG. 6 is a fragmentary view which illustrates die removal from a mill having conventional roller mounting.

DETAILED DESCRIPTION

Figure 1:
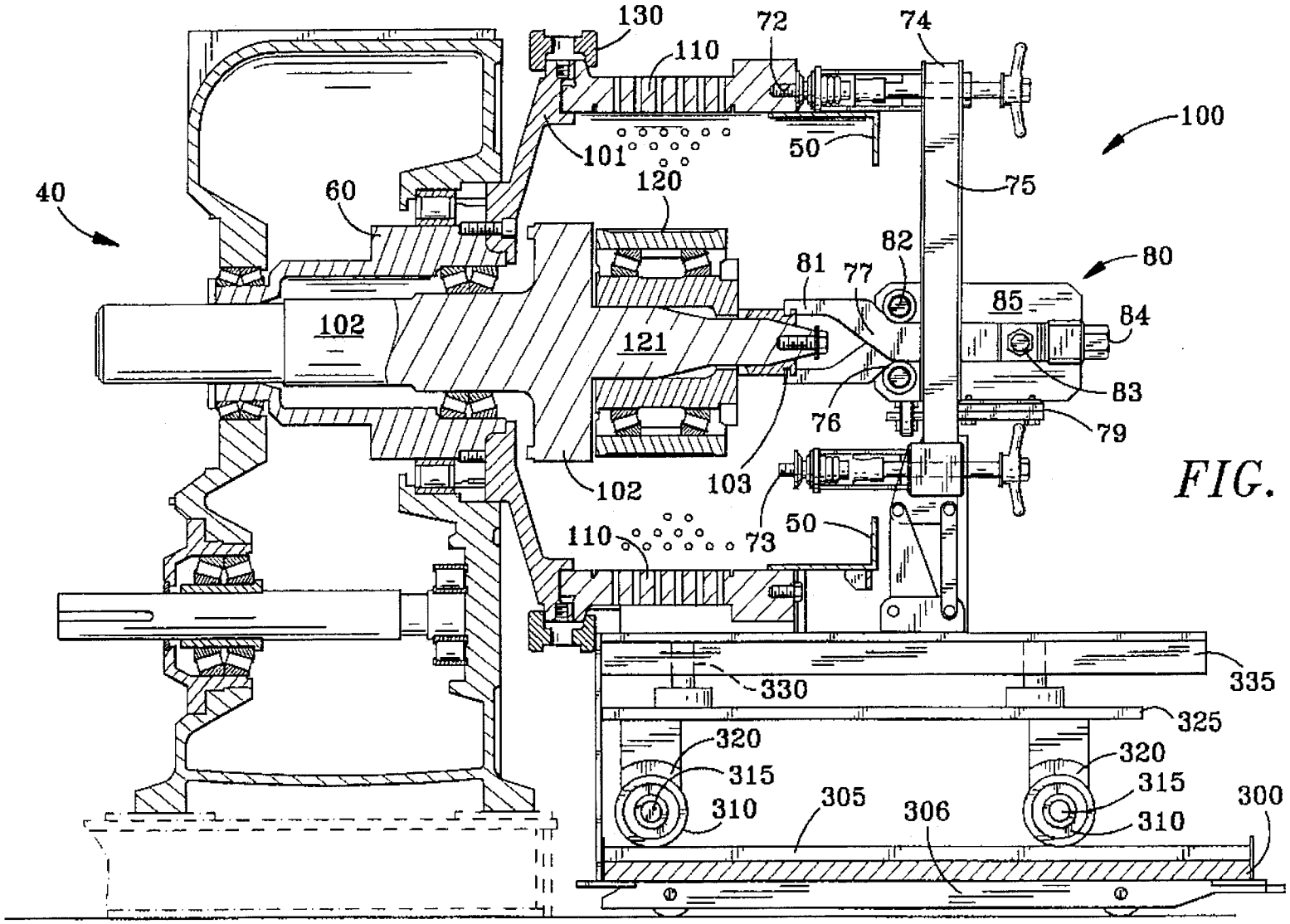
FIG. 1 is a fragmentary schematic side elevation view illustrating, in partial section, the interrelationship between components of the preferred embodiment of the die change system of the present invention and a roller/die cartridge.
Figure 2:
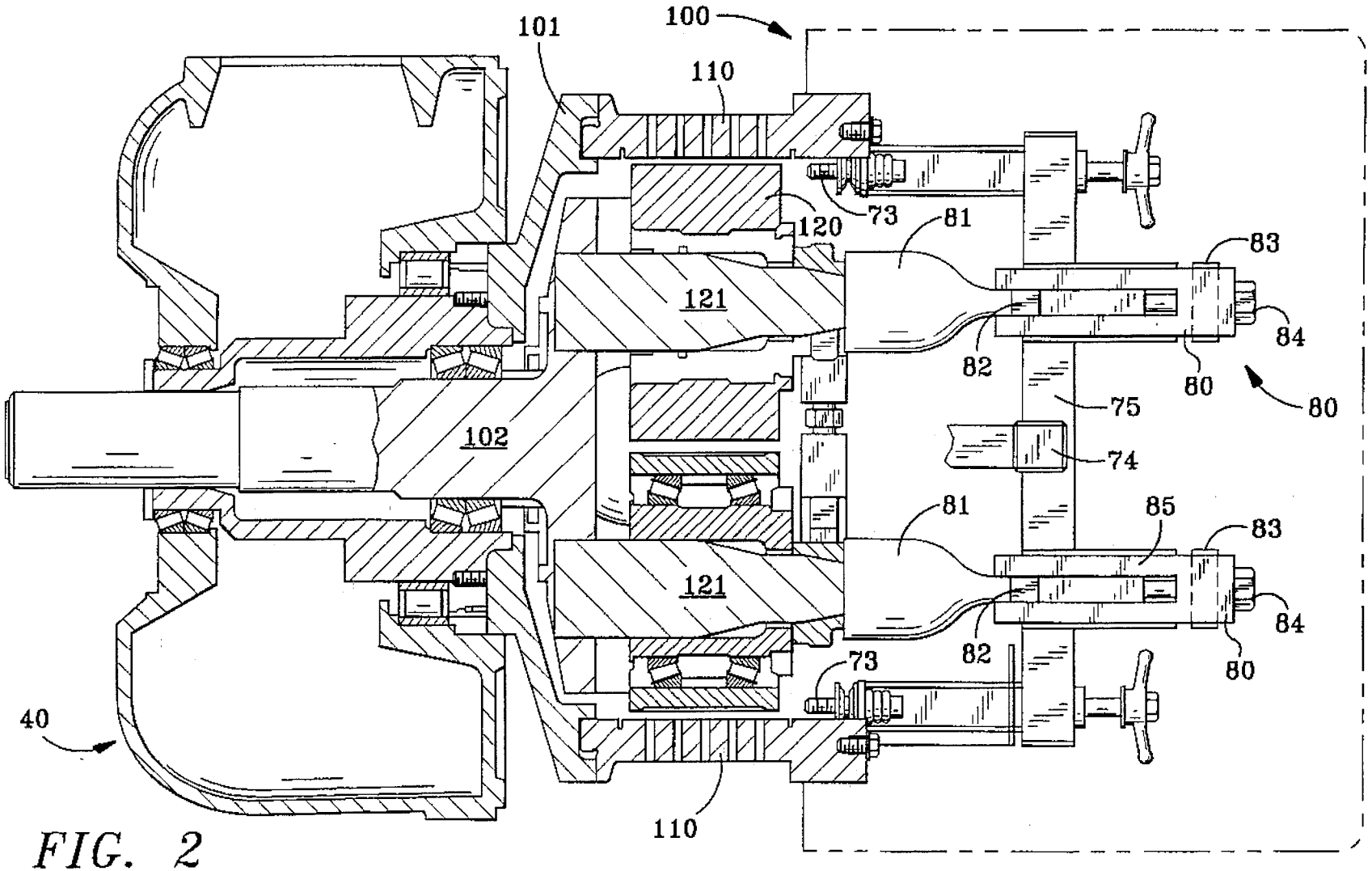
FIG. 2 is a top view showing additional features of the system shown in FIG. 1.

FIG. 1 shows an overall view of the quick die change system of the present invention. A sectional view of a pellet mill 40 illustrates the quill shaft 60, the quill flange 101, and main shaft 102. Die 110 is mounted on quill flange 101 and clamped with die clamps 130, while rollers 120 are mounted on cantilevered extensions 121 of main shaft 102. In some instances, the cantilevered extensions 121 have a series of steps, as shown in FIGS. 1, 2 and 6. Also mounted on die 110 is feed cone 50.

A unitized roller/die cartridge set 100 (such as is shown still attached to pellet mill 40 in FIG. 1, or the alternative embodiment shown separated from pellet mill 40 in FIG. 6) is formed by the fixturing action provided by fixture spider 75 in conjunction with roller grips 80. By turning clamp nut 84, clamp arms 77 are advanced or withdrawn relative to grip clamp frame 85. This causes cam surfaces 76 of clamp arms 77 to respond to forces exerted by cam rollers 82 and to close or open to grip or release rollers 120 which are held by grip claws 81 in roller grip slot 103 of roller 120 at the opposite end of the roller grip 80 from clamp arm pivot 83. At the outboard end of each arm 74 of fixture spider 75 is a bolt 73 as seen in FIGS. 1, 2, and 6, which extends from the arms 64 of the fixture spider 75 and is threaded into a bolt hole 72 in the axial face of the die 110. When thus attached, fixture spider 75 forms a unitized roller/die cartridge set 100 by its fixturing action between rollers 120 and die 110 as provided by the bolts 73 and the roller grips 80. When die clamps 130 are released and the rollers 120 are unfastened from the quill shaft 102, the roller die cartridge set 100 can be removed from the pellet mill 40 as shown in the embodiment illustrated in FIG. 6.

When attached to the fixturing spider, the roller/die cartridge set 100 may be handled as a unitized assembly in which the relative positions of the rollers 120 and the die 110 are maintained. Fixture spider 75 is mounted on a platform having a first lower level 325 and a second upper level 335 which are connected by jacking devices 330. These jacking devices 330 permit raising and lowering of the second upper level 335 of the platform with respect to first lower level 325. A transporter base 300 which is adapted for transportation on a pallet jack 306 (a portion of the pallet jack 306 being shown in FIGS. 1, 3 and 6) or the like has two or more rails 305 upon which rolling members 310 are situated. Preferably, rolling members 310 and rails 305 will have mating grooves and projections or other provision for maintaining engagement. The rolling members 310 are mounted on axles 315. Between the axles 315 and first lower level 325 of the platform are supports 320 which provide anti-friction engagement with the axles 315. This mounting support scheme (jacking devices 330, rolling members 310 and anti-friction supports 320) provides position adjustability for fixture spider 75 along three orthogonal axes.

FIG. 2 is a top view, of the system shown in FIG. 1, to provide additional detail of the invention. Here the unitized roller/die cartridge set 100 is shown attached to fixture spider 75. In this view, further detail of the mounting of rollers 120 on main shaft 102, the mounting of die 110 to quill flange 101, and the gripping arrangement afforded by roller grips 80 are seen. Grip claws 81 are disposed at the ends of the clamp arms 77 which are hinged together by clamp arm pivot 83 in grip clamp frame 85. Cam rollers 82 act on cam surfaces 76 of clamp arms 77 to operate grip claws 81 in response to the action of clamp nut 84, to close and open the grip of grip claws 81.

Figure 3:
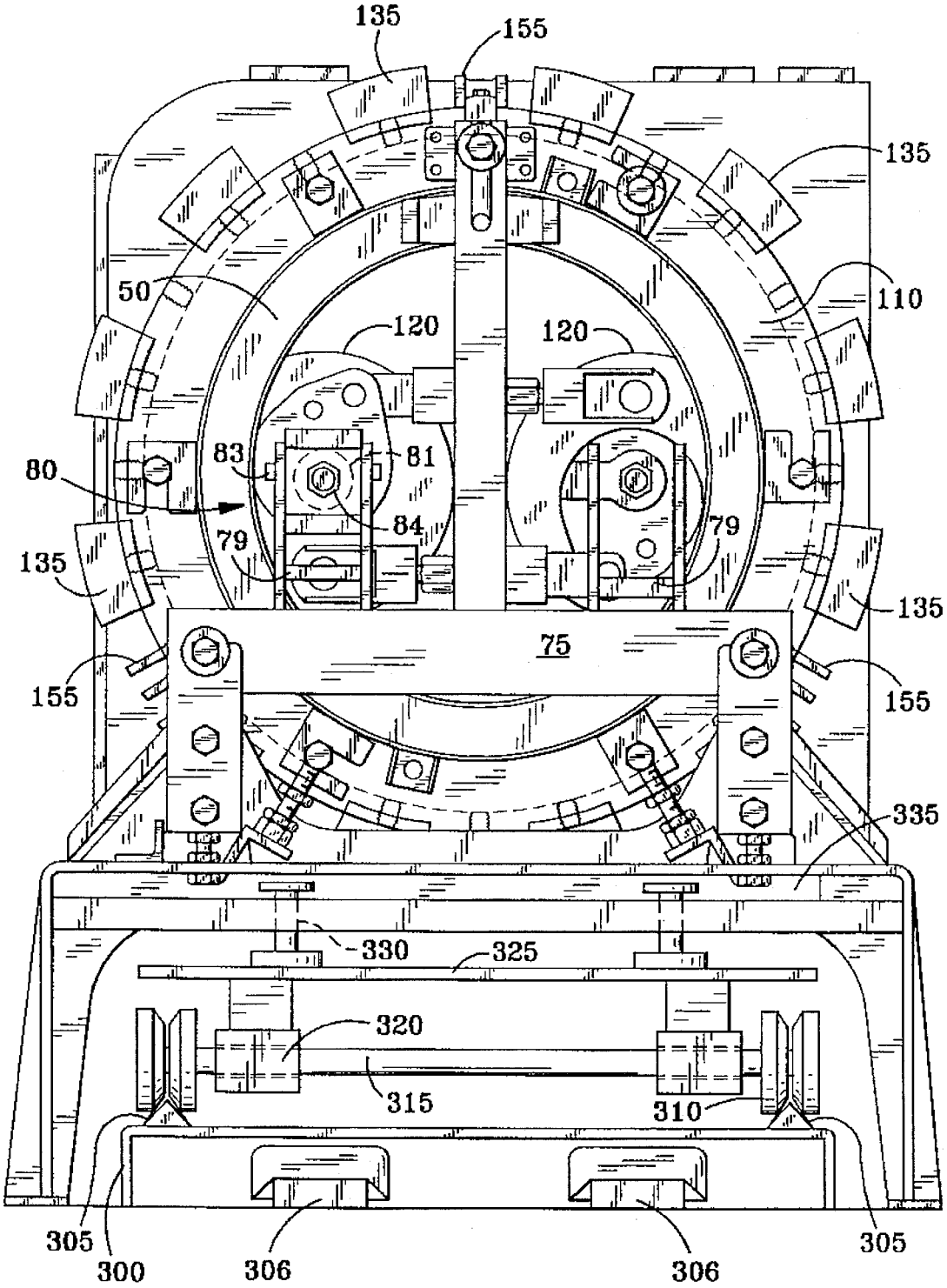
FIG. 3 shows a front elevation view of a die/roller set attached to the spider of the fixture frame.

FIG. 3 shows a front elevation view of the system of the present invention to provide additional detail of the invention. Segmented arcuate die clamps 130 are seen arrayed around die 110. Feed cone 50 projects outward from the face of die 110. A roller grip 80 is illustrated on the left side, but has been eliminated from the right side to reveal greater detail. It can be seen that roller grip 80 is mounted on roller grip mount 79. In this view grip claws 81 are only shown in phantom representation. Also, the ends of clamp arm pivot 83 and clamp nut 84 are shown.

In this figure, also, is another view of the position adjustment provisions of the invention. The transporter base 300 supports rails 305 upon which rolling members 310 may travel. Rolling members 310 are mounted at the ends of axles 315 and anti-friction supports 320 connect axles 315 to first lower level 325 of the platform. Jacks 330 join first lower level 325 to second upper level 335 of the platform. The fixture spider 75 is mounted on second upper level 335 of the platform. This figure also shows push-pull screw jack ears 155. There is one set of ears 155 aligned on die 110 with each of the registration points. This permits jacking at the three locations to separate the die from the quill flange or to nest it firmly against the quill flange.

Figure 4:
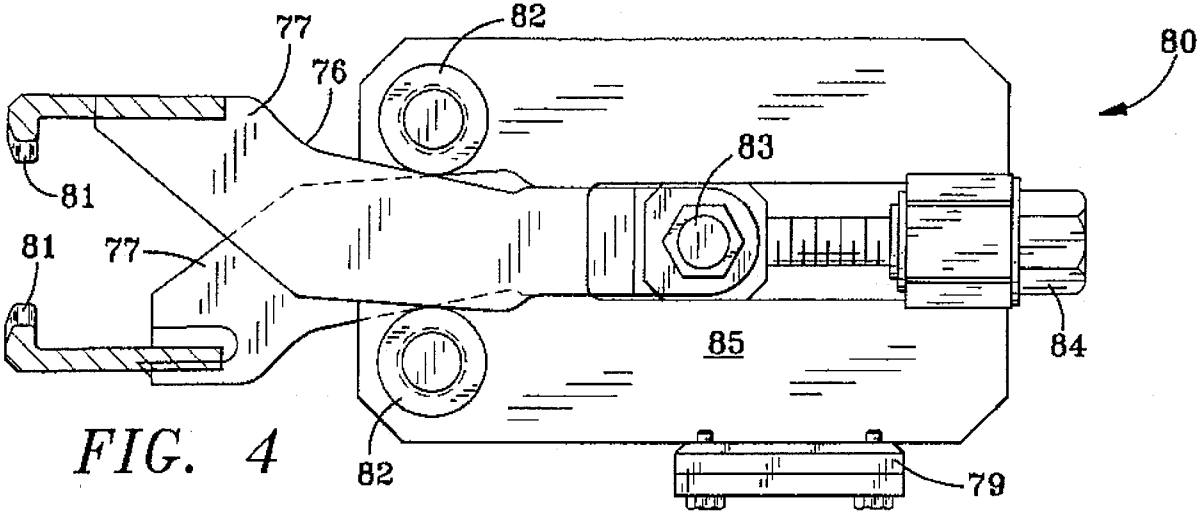
FIGS. 4 and 4 show the roll gripper assembly in the open condition and as clamped to a roll extension, respectively.
Figure 4A:
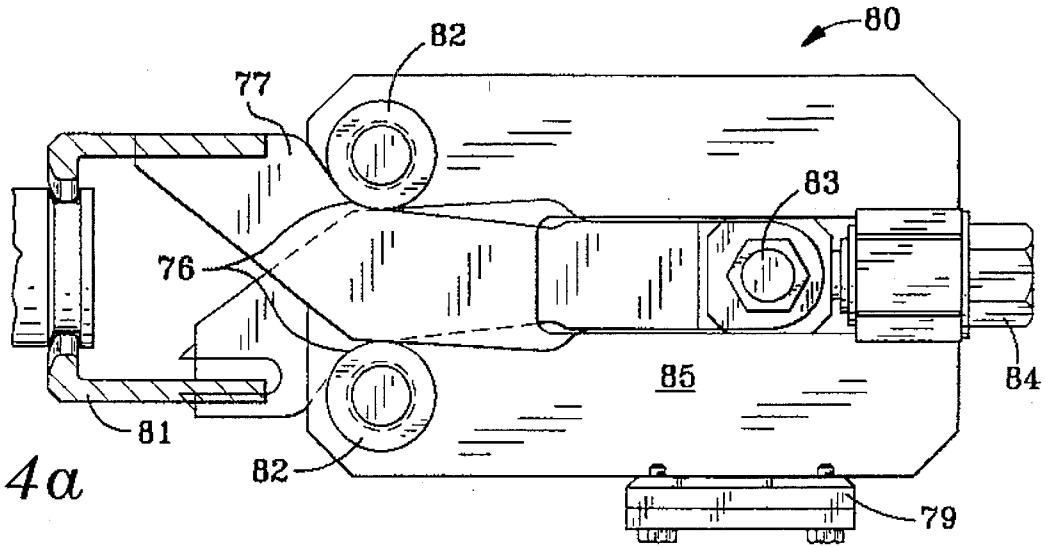

FIGS. 4 and 4*a* show a roller grip 80 having a rigid grip clamp frame 85, clamp arms 77, grip claws 81, clamp arm pivot 83, and clamp nut 84. As clamp nut 84 is turned, it moves clamp arm pivot 83 together with clamp arms 77 and grip claws 81 to either the left or the right side, relative to rigid grip clamp frame 85, as viewed in these figures. When moved to the right, cam surfaces 76 on the back of clamp arms 77 ride against cam rollers 82 which are rotatably mounted on grip clamp frame 85. This causes grip claws 81 to close as shown in FIG. 4*a*. When clamp arm pivot 83 moves to the left, grip claws 81 open in response to the lessening of cam force exerted on the cam surfaces 76 of clamp arms 77 by cam rollers 82. This clamping and unclamping action as shown in FIGS. 4*a* and 4, respectively, is easily accomplished with a power wrench.

FIGS. 5 and 5*a* show details of die clamp 130. Considering both figures, it is seen that die clamp 130 consists of clamp body 135 which is bolted to quill flange 101 by stud 131 which has a nut 134 captured within clamp body 135 by disc spring 133 and retainer washer 132. It can be seen that leg 136, which bears against the flange of pelleting die 110, is shorter than leg 137 which bears against quill flange 101. Since this is so, it is not necessary to completely remove the die clamp 130 in order to remove the die. Moreover, leg 137 bearing against quill flange 101 maintains alignment of die clamp 130 when the die is removed. The means for clamping the pelleting die 110 to the quill shaft 101 being a plurality of arcuate bars 130, each subtending between 5 and 45 degrees of arc and each having a tapered groove of width sufficient to clamp the combined thickness of the quill flange and the die flange, wherein the width is larger at radially inward extremities of the legs.

FIG. 6 shows a conventionally mounted die and roller set in the process of removal by the present invention. Here, the main shaft 102 has a socket 910 for receiving the back end of roller shaft 908 which is bolted in place by an axial bolt (not shown) through shaft 908. In this case, rollers 120 are tied together by front roller support 900 which has a grip slot 903 in which grip claws 81 can grip the roller assembly.

In its preferred embodiment, this invention provides for rapid roller and die change in a pellet mill while involving a minimal mass for transport to and from the mill. By selection of appropriate die and roller mounting mechanisms, it has become possible to clamp the die and rollers in such a way as to form a unitized die roller cartridge.

The foregoing has described a new system for providing rapid die change capability in a pellet mill. It has been described and illustrated with reference to a preferred embodiment. Clearly, the particular embodiment chosen will depend upon the various factors which influence the die changing operation.

What is claimed is:

1. An apparatus for positively gripping a pellet mill die and rollers for removing and installing said die and rollers in a pellet mill comprising:

a fixture spider having a plurality of rigidly mounted arms projecting outwardly a sufficient distance to provide registration with a plurality of attachment sites on an annular axial circular face of said die;

means, distally disposed on said arms, for positively attaching said fixture spider to said attachment sites on said annular axial circular face of said die; and means, attached to said fixture spider, for positively gripping rollers.

2. The apparatus of claim 1, further comprising:

means for moving said fixture spider along three orthogonal axes to align said means for positively attaching said fixture spider to said attachment sites on said annular axial circular face of said die.

3. The apparatus claim 2, wherein the means for moving said fixture spider along three orthogonal axes is mounted on a transporter base means for transporting the fixture spider together with the die and rollers.

4. The apparatus of claim 1, wherein the means, distally disposed on said arms, for positively attaching said fixture spider to said attachment sites on said annular axial circular face of said die comprises bolts which extend from the arms of the fixture spider to the attachment sites on said die, said attachment sites comprising holes which engage said bolts.

5. The apparatus of claim 1, wherein the plurality of rigidly mounted arms comprise three arms, the ends of which are equidistant from each other.

6. The apparatus of claim 1, wherein the means for gripping rollers comprises a plurality of roller grips, each said grip having two opposed matching grip claws on grip arms, said arms being pivotally connected together to a moveable pivot and to a grip clamp frame, the moveable pivot being connected to a clamp nut and moving in response to turning movement of the clamp nut, the movement of the pivot causing movement of cam surfaces of the clamp arms against rollers rigidly and rotatably mounted on said grip clamp frame, the movement of the cam surfaces against the rollers causing the grip claws to grip or release the rollers.

7. The apparatus of claim 2, wherein the means for moving said fixture spider along three orthogonal axes to align said means for positively attaching with said attachment sites on said annular axial circular face of said die comprises:

a platform having a first level and a second level above said first level, said levels connected by jacking means for raising and lowering the second level with respect to the first level, said fixture spider being attached to a top surface of the second level;

a transporter base having at least two parallel rail members upon which are supported a plurality of rolling members; and a plurality of anti-friction support members, mounted on a lower surface of said first level of said platform, which provide anti-friction rolling support along axle members which extend transversely to said parallel rail members between the rolling members supported by said rail members, and which attach said axle members to said first level of said platform.

8. An apparatus for providing roller/die change capability to a pellet mill, said mill having a main shaft with at least one cantilevered extension with a roller mounted upon each cantilevered extension and a hollow quill shaft upon which a cylindrical pelleting die is mounted, the cylindrical pelleting die having a radially extending die flange, comprising:

means, mounted on a quill flange of said quill shaft, for clamping the pelleting die to the quill shaft and for releasing the die from the quill shaft;

means for, simultaneously with clamping and releasing of the pelleting die, mounting rollers on or removing rollers from said cantilevered extensions;

means for grasping and holding the rollers and the die for handling as a unitized roll/die cartridge during removal, installation, storage, transportation; and means for providing adjustability on three orthogonal axes for accurate positioning of said means for grasping and holding the rollers and the die for handling as a unitized roller/die cartridge during installation in and removal from said mill.

9. The apparatus of claim 8, wherein the means for clamping of the pelleting die to the quill shaft and releasing the pelleting die from the quill shaft comprises a plurality of arcuate clamp bars disposed about a peripheral surface of the quill flange on said quill shaft; each clamp bar subtending between five degrees and forty-five degrees of arc along said peripheral surface; each clamp bar having a tapered groove between two legs, axially spaced with respect to said quill shaft and said pelleting die, said groove having a width sufficient to the clamp combined thickness of the quill flange and the die flange; each clamp bar having a radially directed captured nut member on a stud member for fastening said clamp bar to said quill flange; and said two legs being a radially short leg and a radially long leg with respect to the quill flange, said short leg bearing against the die flange and said long leg bearing against the quill flange so that when loosened sufficiently to release said die flange the clamp bars remain in alignment with said quill flange and so that the pelleting die can be removed without separating the clamp bars from the quill flange.

10. The apparatus of claim 8, wherein the means for grasping and holding the rollers and the pelleting die comprises a fixture spider having a plurality of rigidly mounted arms projecting outwardly a sufficient distance to provide registration with a plurality of attachment sites on an annular circular face of said die; means, distally disposed on said arms, for positively attaching said fixture spider to said attachment sites on said axial face of said die; and means for gripping rollers, said means for gripping being fixed to said fixture spider.

11. The apparatus of claim 10, wherein the means for providing adjustability for accurately positioning on three orthogonal axes comprises:

a platform having a first level and a second level above said first level, said levels connected by a jacking means for raising and lowering the second level with respect to the first level, said fixture spider being attached to an upper surface of said second level;

a transporter base having at least two parallel rail members upon which are supported a plurality of rolling members; and means for enabling movement of said unitized roller/die cartridge along an axis orthogonal to the axes of motion permitted by said jacking means and said parallel rail members, said means for enabling movement of said unitized roller/die cartridge along an axis orthogonal to the axes of motion permitted by said jacking means and said parallel rail members connecting said rolling members to said first level of said platform.

* * * * *